US006257930B1

(12) United States Patent
Yu

(10) Patent No.: US 6,257,930 B1
(45) Date of Patent: Jul. 10, 2001

(54) USB ELECTRICAL CONNECTOR

(75) Inventor: Wei-Ting Yu, Taipei Hsien (TW)

(73) Assignee: Advanced Connecteck Inc., Hsintien (TW)

( * ) Notice: Subject to any disclaimer, the term of this patent is extended or adjusted under 35 U.S.C. 154(b) by 0 days.

(21) Appl. No.: 09/659,190

(22) Filed: Sep. 12, 2000

(30) Foreign Application Priority Data

Sep. 30, 1999 (TW) ..... 088216530

(51) Int. Cl.[7] ..... H01R 13/648

(52) U.S. Cl. ..... 439/607

(58) Field of Search ..... 439/607

(56) References Cited

U.S. PATENT DOCUMENTS 2,776,415 * 1/1957 McGinley ..... 439/607
5,772,472 * 6/1998 Beutler et al. ..... 439/608
6,007,380 * 12/1999 Shimojyo ..... 439/607

* cited by examiner

*Primary Examiner*—Khiem Nguyen
*Assistant Examiner*—Javaid Nasri
(74) *Attorney, Agent, or Firm*—Merchant & Gould P.C.

(57) ABSTRACT

A USB electrical connector includes an insulative seat body having a top wall and a protrusion projecting from the top wall, a plurality of terminals mounted on the seat body, and a metal shell snugly receiving the seat body and having a front open end, a top wall which has an opening interlocking with the protrusion, a slit that extends from the front open end to the opening, and two opposite resilient anchor plate portions that extend between the front open end and the opening on two opposite sides of the slit.

1 Claim, 8 Drawing Sheets

USB ELECTRICAL CONNECTOR

BACKGROUND OF THE INVENTION

1. Field of the Invention

This invention relates to an electrical connector, more particularly to a USB electrical connector.

2. Description of the Related Art

There are two standard types of USB (Universal Serial Bus) electrical connectors, namely A-type and B-type USB connectors, that are currently adopted for computers. FIG. 1 illustrates a conventional A-type USB electrical connector. The connector includes an insulative seat body 10 that has a planar top wall 101 and a pair of protrusions 100 projecting upwardly from the top wall 101, a plurality of terminals 12 mounted on the seat body 10, a metal shell 11 that snugly receives the seat body 10 and that has a front open end for insertion of the seat body 10, and a planar top wall 111 formed with a pair of openings 110 adjacent to the front open end and engageable with the protrusions 100 for securing the seat body 10 to the metal shell 11, and a plastic housing 13 having a front open end 130 for insertion of the assembly of the seat body 10 and the metal shell 11 so as to enclose the same.

Referring now to FIGS. 2A to 3B, in combination with FIG. 1, since the protrusions 100 of the seat body 10 pushes against a bottom face of the top wall 111 of the metal shell 11 during insertion of the seat body 10 into the metal shell 11, there is a tendency for the top wall 111 of the metal shell 11 to be permanently deformed due to forces resulting from the pushing action. Moreover, the deformation of the metal shell 11 increases the difficulty of inserting the assembly of the seat body 10 and the metal shell 11 into the plastic housing 13.

SUMMARY OF THE INVENTION

Therefore, the object of the present invention is to provide a USB electrical connector that is capable of overcoming the aforementioned drawback.

According to the present invention, a USB electrical connector comprises: an insulative seat body having a planar top wall and a protrusion projecting upwardly from the top wall; a plurality of terminals mounted on the seat body; and a metal shell snugly receiving the seat body and having a front open end for insertion of the seat body, and a planar top wall which has an opening adjacent to the front open end to interlock with the protrusion, a slit that extends from the front open end to the opening along a line parallel to the direction of insertion of the seat body, and two opposite resilient anchor plate portions that extend between the front open end and the opening on two opposite sides of the slit, the anchor plate portions being flexible to prevent permanent deformation due to pushing by the protrusion when the seat body is inserted into the metal shell.

BRIEF DESCRIPTION OF THE DRAWINGS

In drawings which illustrate embodiments of the invention.

DETAILED DESCRIPTION OF THE PREFERRED EMBODIMENTS

Figure 1:
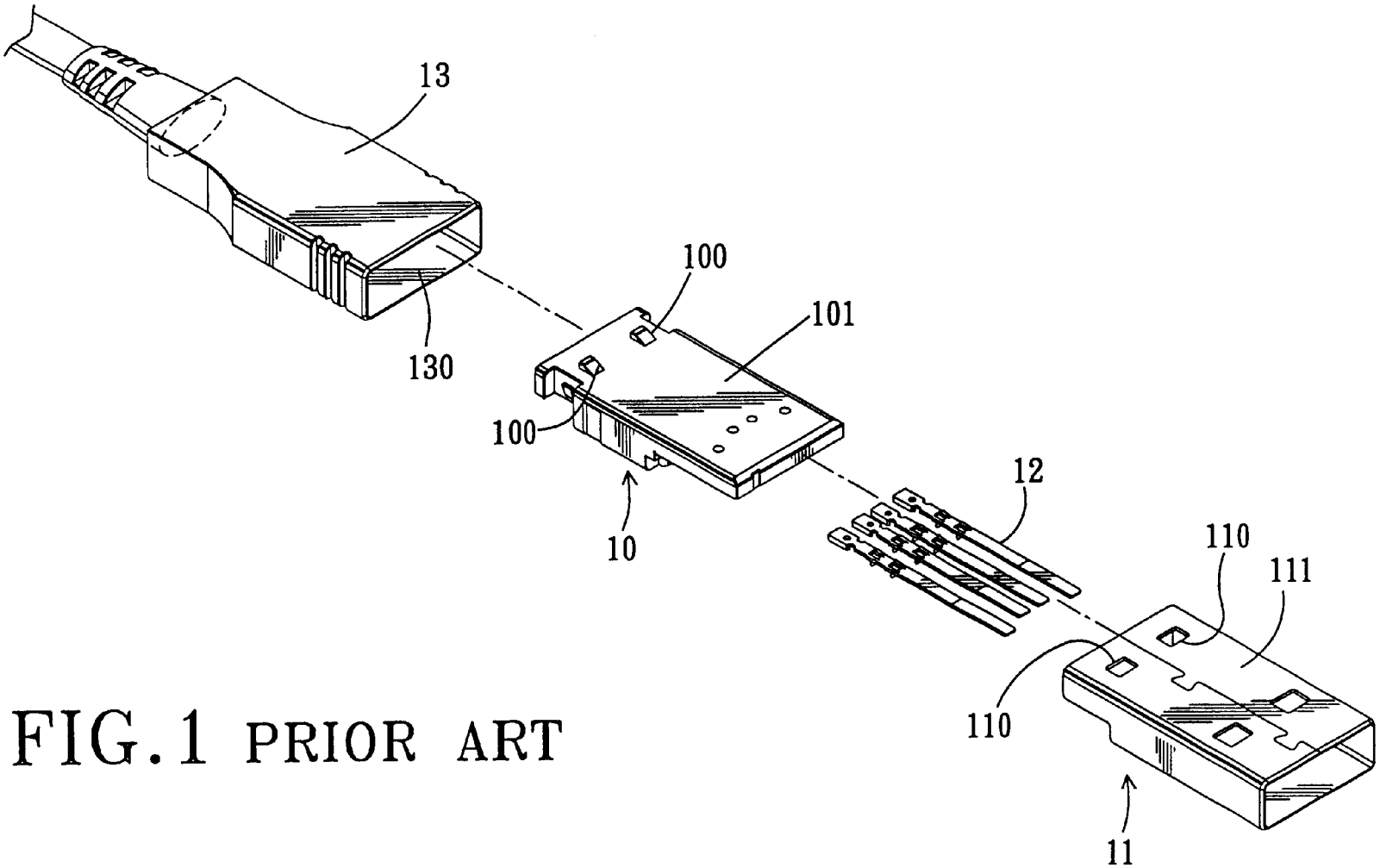
FIG. 1 PRIOR ART
FIG. 1 is an exploded perspective view of a conventional A-type USB electrical connector.
Figure 2B:
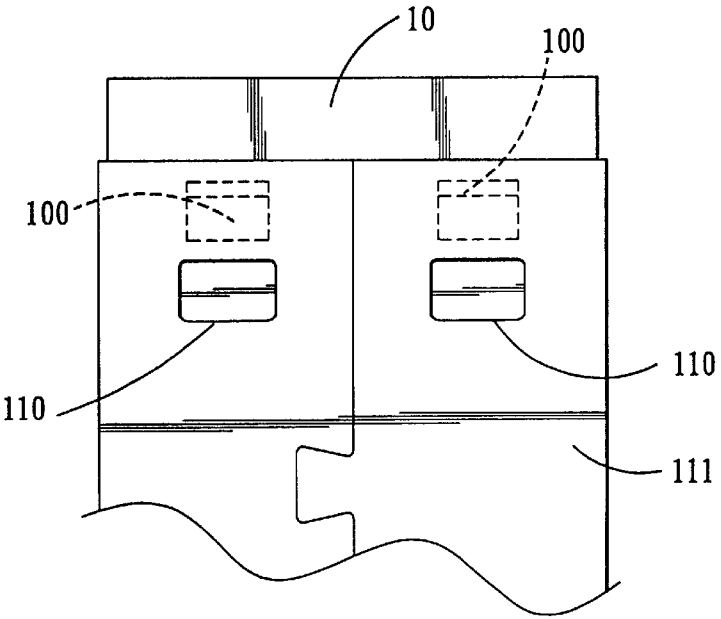
FIG.2B PRIOR ART
FIGS. 2A and 2B are respectively front and top views to illustrate deformation of a metal shell upon insertion of an insulative seat body of the connector of FIG. 1 into the metal shell.
Figure 2A:
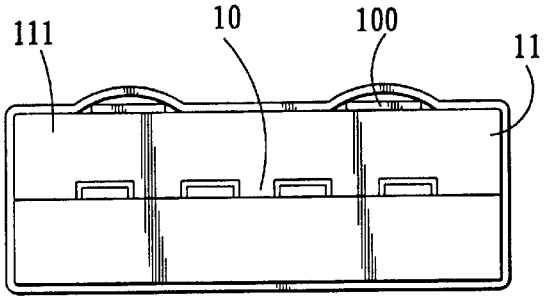
FIG.2A PRIOR ART
Figure 3B:
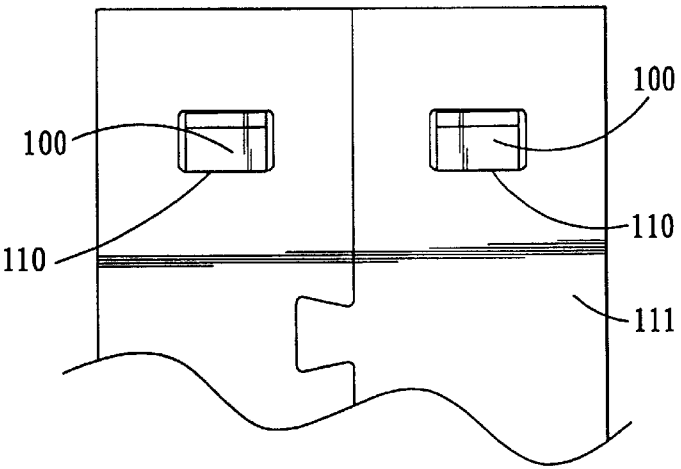
FIG.3B PRIOR ART
FIGS. 3A and 3B are respectively front and top views to illustrate permanent deformation of the metal shell after insertion of the insulative seat body of the connector of FIG. 1 into the metal shell.
Figure 3A:
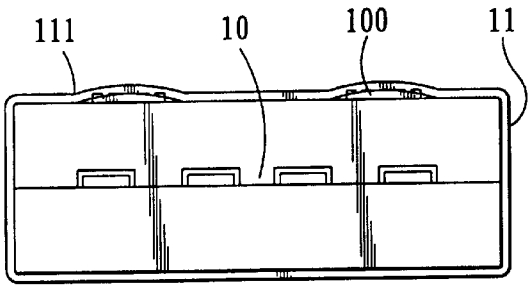
FIG.3A PRIOR ART
Figure 4:
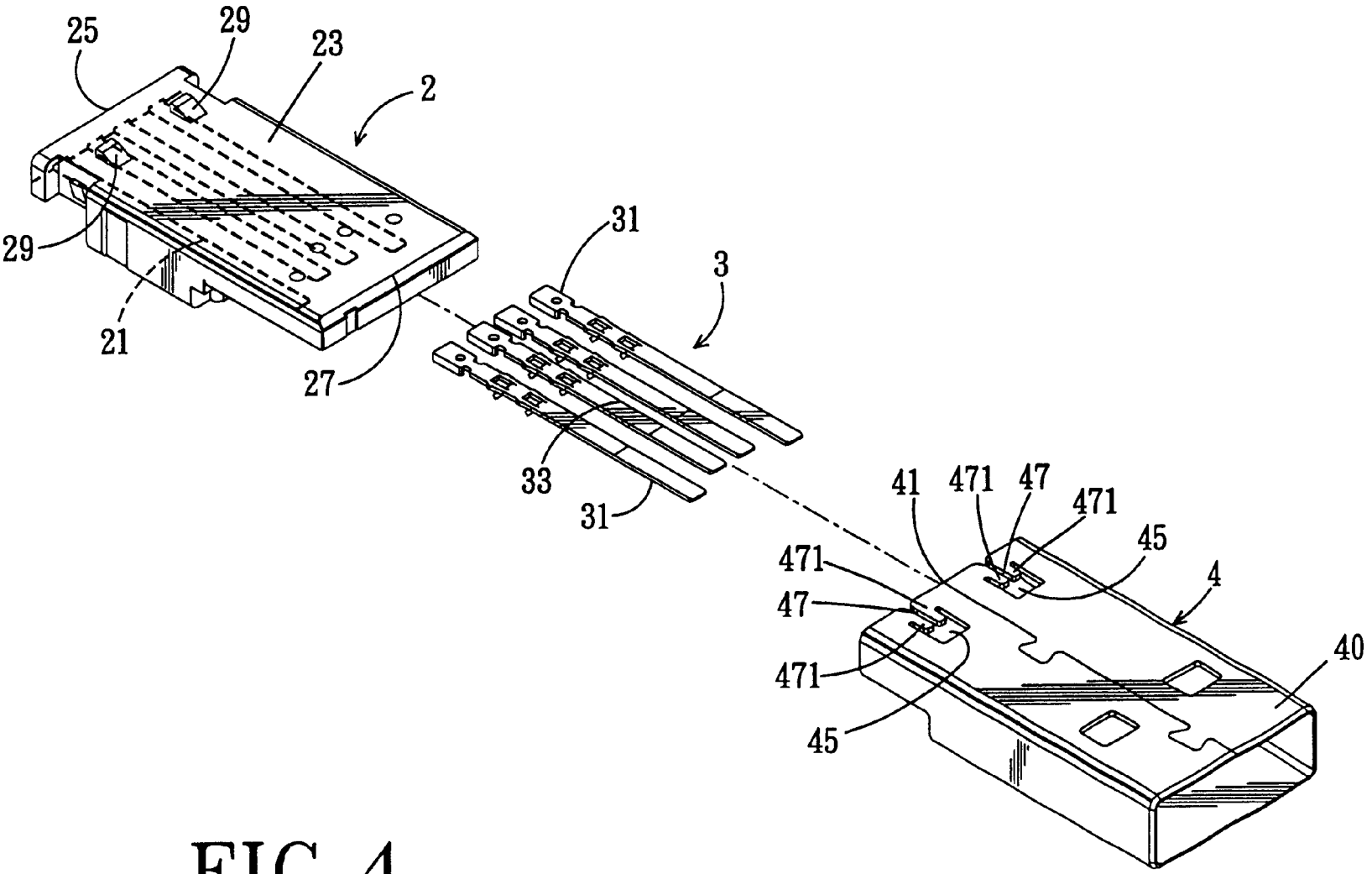
FIG. 4 is an exploded perspective view of an A-type USB electrical connector embodying this invention.
Figure 5B:
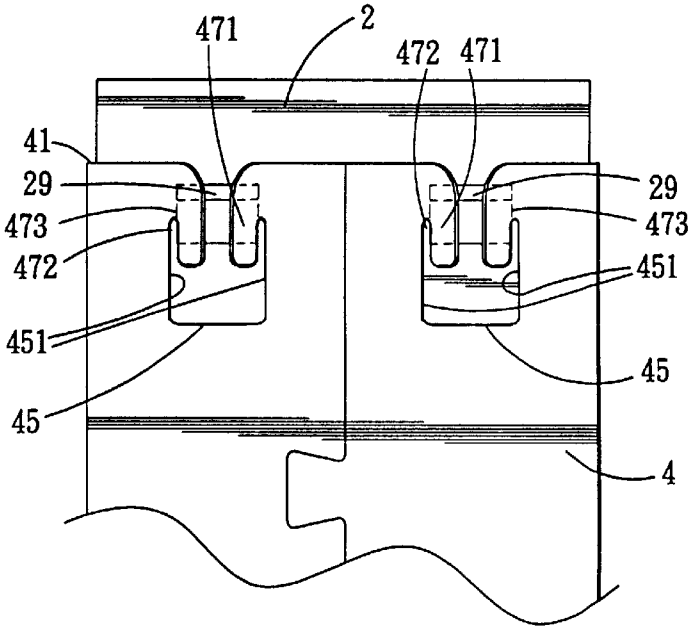
FIGS. 5A and 5B are respectively front and top views to illustrate deformation of anchor plate portions of a metal shell upon insertion of an insulative seat body.
Figure 5A:
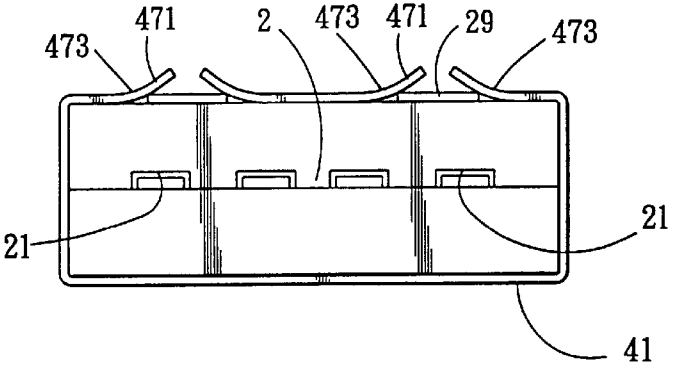
Figure 6B:
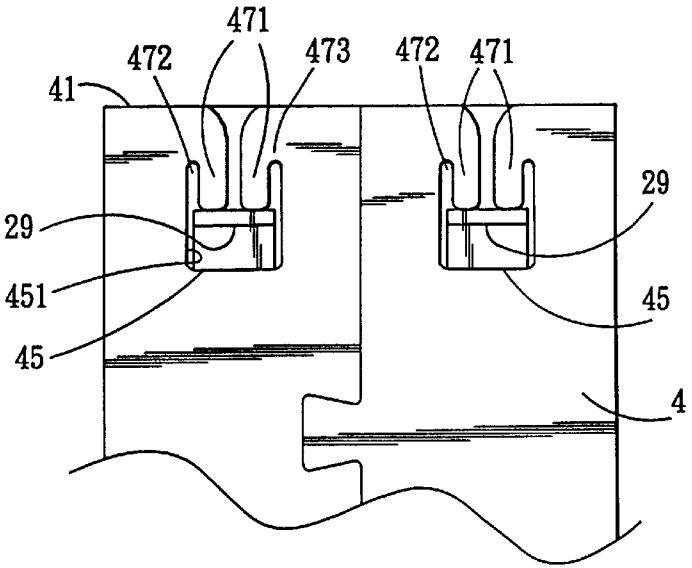
FIGS. 6A and 6B are respectively front and top views to illustrate recovery of the anchor plate portions of the metal shell from the deformed state after insertion of the insulative seat body.
Figure 6A:
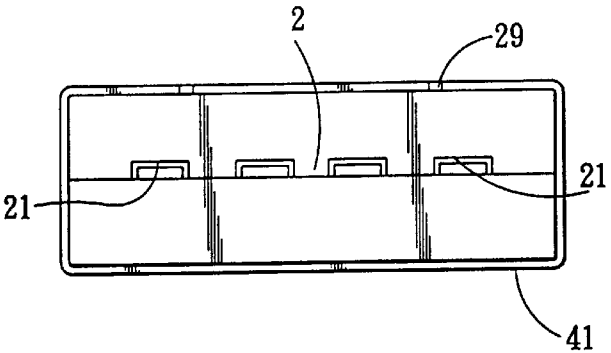
Figure 8:
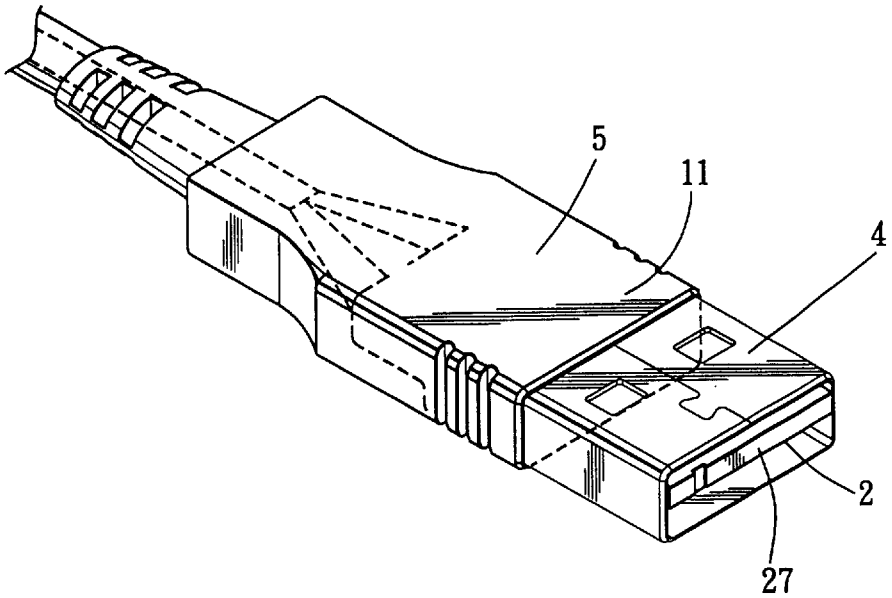
FIG. 8 is a perspective view of the electrical connector of FIG. 4 enclosed by a plastic housing.

FIGS. 4 and 8 illustrate an A-type USB electrical connector embodying this invention. The connector includes an insulative seat body 2, a metal shell 4, four terminals 3, and a plastic housing 5.

The seat body 2 has two opposite ends 25, 27, and includes a planar top wall 23, a pair of protrusions 29 projecting upwardly from the top wall 23, and four terminal passageways 21 formed therein and extending between the opposite ends 25, 27 for receiving respectively the four terminals 3.

The four terminals 3 include two power terminals 31 and two data terminals 33 disposed between the power terminals 31.

The metal shell 4 snugly receives the seat body 2, and has a front open end 41 for insertion of the seat body 2, and a planar top wall 40 that has a pair of openings 45 formed therein adjacent to the front open end 41 to interlock with the protrusions 29, and a pair of slits 47 formed therein and extending from the front open end 41 to the openings 45 along lines parallel to the direction of insertion of the seat body 2. A pair of opposite resilient anchor plate portions 471 are formed in the top wall 40 at two opposite sides of each of the slits 47, and extend between the front open end 41 and the corresponding opening 45.

The plastic housing 5 receives and encloses the assembly of the seat body 2 and the metal shell 4.

Referring now to FIGS. 5A to 6B, in combination with FIG. 4, each pair of the anchor plate portions 471 is flexible so that the protrusions 29 can push thereagainst and interlock with the openings 45 without permanently deforming the anchor plate portions 471 when the seat body 2 is inserted into the metal shell 4. The anchor plate portions 471 are bent upwardly during the pushing action of the protrusions 29 and then recover to their non-bent state once the protrusions 29 pass through the anchor plate portions 471 and interlock with the openings 45. The planar top wall 40 of the metal shell 4 further has two opposite edges 451 extending in the direction of insertion of the seat body 2 and bounding the respective opening 45, each of the anchor plate portions 471 having an elongated cut 472 communicating with and extending forwardly from the opening 45 toward the front open end 41 along a line extending from an adjacent one of the edges 451, and a neck 473 extending between the cut 472 and the front open end 41. The necks 473 permit the anchor plate portions 471 to recover to their non-bent state.

Figure 7:
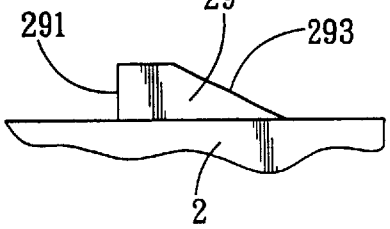
FIG. 7 is a side view of a protrusion of the insulative seat body of the electrical connector of FIG. 4.

Referring now to FIG. 7, in combination with FIG. 4, each protrusion 29 is substantially wedge-shaped, and has a shoulder 291 engageable with the corresponding anchor plate portions 471, and a slanting face 293 disposed reawardly of the shoulder 291 for pushing against the anchor plate portions 471 when the seat body 2 is inserted into the metal shell 4.

Figure 9:
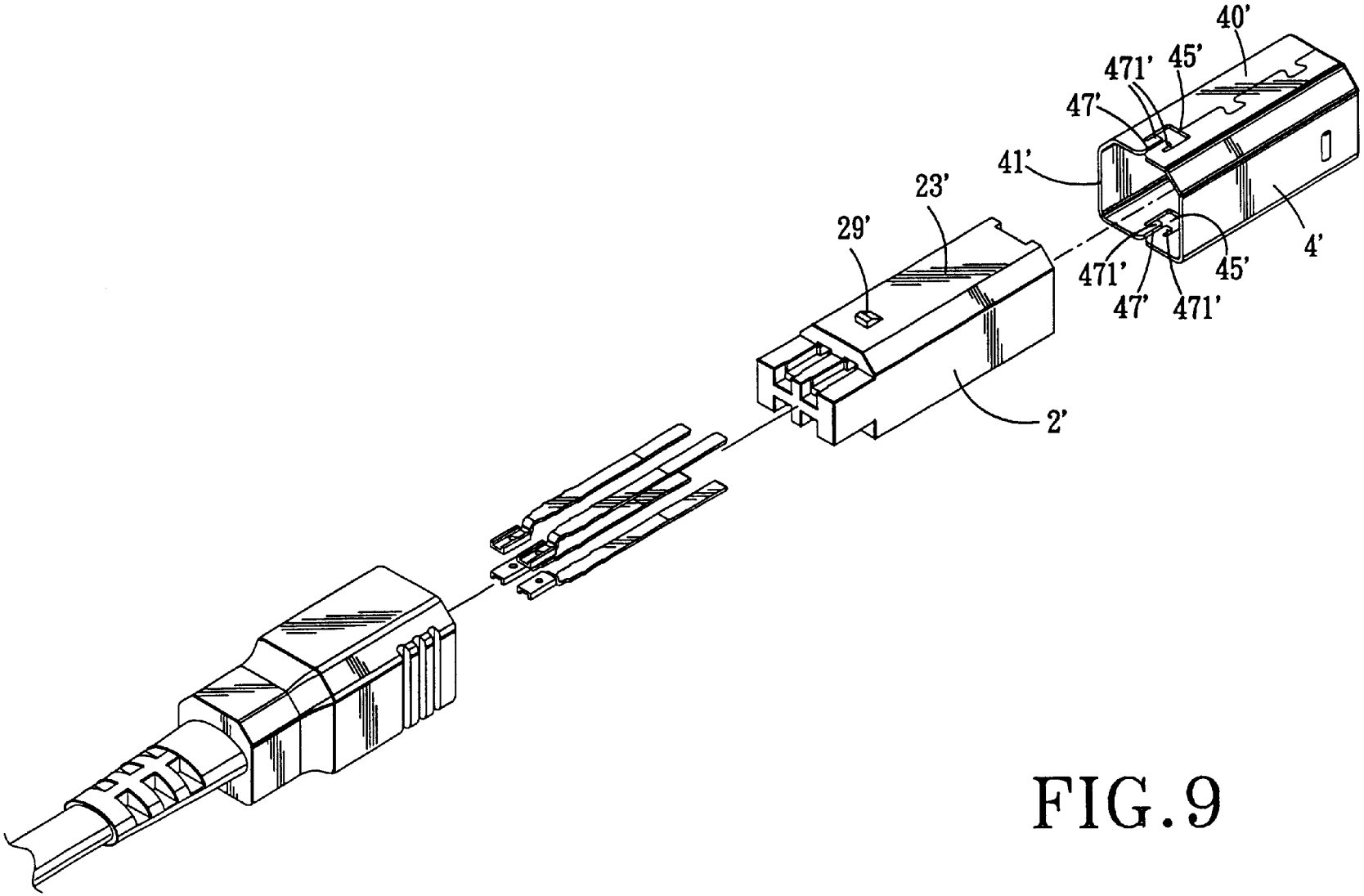
FIG. 9 is an exploded perspective view to illustrate another embodiment of this invention in the form of a B-type USB electrical connector.

FIG. 9 illustrates another embodiment of this invention in the form of a B-type USB electrical connector. In this embodiment, one of the openings 45', one of the slits 47', and one of the two pairs of the anchor plate portions 471' are formed in a bottom wall of the metal shell 4' instead of in the top wall 40' of the metal shell 4', and one of the protrusions 29' is formed in a bottom wall of the seat body 2' instead of in the top wall 23' of the seat body 2'.

With the design of the slits 47 and the anchor plate portions 471, the undesired deformation of the metal shell 11 and the difficulty of assembling the plastic housing 13 unto the metal shell 11 and the seat body 10 as encountered in the prior art can be eliminated.

With the invention thus explained, it is apparent that various modifications and variations can be made without departing from the spirit of the present invention. It is therefore intended that the invention be limited only as recited in the appended claims.

I claim:

1. A USB electrical connector, comprising:

an insulative seat body having a planar top wall and a protrusion projecting upwardly from said top wall;

a plurality of terminals mounted on said seat body; and a metal shell snugly receiving said seat body and having a front open end for insertion of said seat body, and a planar top wall which has an opening adjacent to said front open end to interlock with said protrusion, a slit that extends from said front open end to said opening along a line parallel to the direction of insertion of said seat body to communicate with said opening, and two opposite resilient anchor plate portions that extend between said front open end and said opening on two opposite sides of said slit, said anchor plate portions being flexible to prevent permanent deformation of said metal shell due to pushing by said protrusion when said seat body is inserted into said metal shell; and wherein, said planar top wall of said metal shell further has two opposite edges extending in the direction of insertion of said seat body and bounding said opening, each of said anchor plate portions having an elongated cut communicating with and extending forwardly from said opening toward said front open end along a line extending from an adjacent one of said edges, and a neck extending between said cut and said front open end.

* * * * *

UNITED STATES PATENT AND TRADEMARK OFFICE

CERTIFICATE OF CORRECTION

PATENT NO. : 6,257,930 B1
DATED : July 10, 2001
INVENTOR(S) : Yu

It is certified that error appears in the above-identified patent and that said Letters Patent is hereby corrected as shown below:

Title page,
Item [73], Assignee: "Connecteck" should read -- Connectek --

Signed and Sealed this

Fifth Day of November, 2002

*Attest:*

*Attesting Officer*

JAMES E. ROGAN
*Director of the United States Patent and Trademark Office*